US005268264A

United States Patent [19]

Marchetti et al.

[11] Patent Number: 5,268,264

[45] Date of Patent: Dec. 7, 1993

[54] SPECTRALLY SENSITIZED OCTAHEDRAL EMULSIONS WITH BURIED SHELL SENSITIZATION

[75] Inventors: Alfred P. Marchetti, Penfield; Myra T. Olm, Webster, both of N.Y.

[73] Assignee: Eastman Kodak Company, Rochester, N.Y.

[21] Appl. No.: 682,997

[22] Filed: Apr. 10, 1991

[51] Int. Cl.[5] ..... G03C 1/035

[52] U.S. Cl. ..... 430/567; 430/570; 430/603; 430/605

[58] Field of Search ..... 430/567, 569, 570, 605, 430/603

[56] References Cited

U.S. PATENT DOCUMENTS

| | | | |
|---|---|---|---|
| 3,790,390 | 2/1974 | Shiba et al. | 430/567 |
| 3,890,154 | 6/1975 | Ohkubo et al. | 430/434 |
| 4,147,542 | 4/1979 | Habu et al. | 430/346 |
| 4,623,612 | 11/1986 | Nishikawa | 430/375 |
| 4,728,602 | 3/1988 | Shibahara et al. | 430/567 |
| 4,923,793 | 5/1990 | Shibahara | 430/567 |
| 4,937,180 | 6/1990 | Marchetti et al. | 430/567 |
| 5,132,203 | 7/1992 | Bell et al. | 430/567 |

FOREIGN PATENT DOCUMENTS 325235 7/1989 European Pat. Off. .

OTHER PUBLICATIONS

Mees, *The Theory of the Photographic Process*, 3rd Ed., Macmillan, 1966, p. 257.

*Primary Examiner*—Janet C. Baxter
*Attorney, Agent, or Firm*—Carl O. Thomas

[57] ABSTRACT

A photographic emulsion is disclosed in which a spectral sensitizing dye is adsorbed to the surface of octahedral silver bromide grains optionally containing iodide. The grains each contain a buried shell formed in the presence of a hexacoordination complex of iron and at least three cyanide ligands.

12 Claims, 1 Drawing Sheet

SPECTRALLY SENSITIZED OCTAHEDRAL EMULSIONS WITH BURIED SHELL SENSITIZATION

FIELD OF THE INVENTION

The invention relates to silver halide photography. The invention relates more specifically to spectrally sensitized silver halide emulsions.

BACKGROUND OF THE INVENTION

Silver bromide and silver bromoiodide emulsions, hereinafter collectively referred to as silver brom(oiod)ide emulsions, typically exhibit regular or irregular octahedral grain shapes. That is, most if not all of the exterior surface area of the grains is accounted for by {111} crystal faces. The art has adopted the practice of referring to {111} crystal faces octahedral faces, since regular grains with {111} crystal faces take the shape of a regular octahedron.

Silver brom(oiod)ide emulsions possess native imaging sensitivity in the ultraviolet and blue portions of the electromagnetic spectrum. Spectral sensitizing dyes have been developed to extend the imaging response of silver brom(oiod)ide throughout the visible spectrum.

One of the art recognized problems in sensitizing emulsions to regions of the spectrum to which they lack native sensitivity is dye desensitization. Notwithstanding the general recognition of dye desensitization as a problem by those skilled in the art, some elaboration is offered, since it is not intuitively obvious that a silver halide emulsion that shows no response to exposure in a spectral region to which the grains possess no native sensitivity in the absence of a spectral sensitizing dye, but responds in the presence of the dye, has been desensitized. Mees, *The Theory of the Photographic Process*, 3rd Ed., Macmillan, 1966, at page 257, explains dye desensitization a and its verification. When silver halide grains are chemically sensitized, the speed of the emulsion is increased at all wavelengths. Other materials placed in or on the grains desensitize the emulsion at all wavelengths and are referred to as desensitizers. Spectral sensitizing dyes extend the sensitivity of the grains to wavelengths to which the grains lack native sensitivity, but often additionally reduce the sensitivity of the grains in the spectral region of native sensitivity. The reduction of sensitivity imparted by the dye provides an indirect indication that the dye is also reducing sensitivity in the region of spectral sensitization. The generally accepted theory stated by Mees and indicated to be consistent with results obtained by its application is that at any instant of exposure, only a minute fraction of the dye molecules on any grain are in the excited state, with the remaining, unexcited dye molecules remaining capable of adversely affecting grain sensitivity independently of the excited molecules.

Marchetti et al U.S. Pat. No. 4,937,180 recognized that formation of silver brom(oiod)ide grains in the presence of a hexacoordination complex of rhenium, ruthenium, or osmium with at least four cyanide ligands would increase the stability of the emulsions and reduce low intensity reciprocity failure. Marchetti et al recognized that the cyanide ligands were incorporated in the grain structure.

Shiba et al U.S. Pat. No. 3,790,390, Ohkubo et al U.S. Pat. No. 3,890,154, and Habu et al U.S. Pat. No. 4,147,542 disclose emulsions particularly adapted to imaging flash (less than $10^{-5}$ second) exposures. Polymethine cyanine and merocyanine dyes are disclosed having up to three methine groups joining their nuclei with blue flash exposures being suggested with zero, one or two methine linking groups and green flash exposures being suggested with three methine linking groups. In addition to the dyes it is suggested to incorporate in the emulsions compounds of Group VIII metals—i.e., iron, cobalt, nickel, ruthenium, rhodium, palladium, osmium, iridium and platinum. Iron compounds suggested for incorporation are ferrous sulfate, ferric chloride, potassium hexacyanoferrate (II) or (III), and ferricyanide. Shiba et al, Ohkubo et al, and Habu et al suggest incorporation of the iron compounds at any convenient stage from precipitation to coating, indicating that whether the iron is located within or exterior of the grains is inconsequential to the utility taught.

SUMMARY OF THE INVENTION

It has been discovered that by incorporating a hexacoordination complex of iron and at least three cyanide ligands in octahedral silver brom(oiod)ide grains in a buried shell location of selected depth optimum reduction in dye desensitization can be obtained.

In one aspect this invention is directed to a photographic emulsion comprised of radiation-sensitive silver bromide grains optionally containing iodide exhibiting a face centered crystal structure and having {111} crystal races and a spectral sensitizing dye adsorbed to the surface of the grains.

The invention is characterized in that the grains each contain a buried shell formed in the presence of a hexacoordination complex of iron and at least three cyanide ligands, the buried shell being located on a core grain portion having a diameter equal to at least half of the grain diameter and beneath a surface shell having a thickness in the range of from 20 to 350 Å.

An important feature of the invention is that coordinating the cyanide ligands with iron eliminates any necessity of incorporating into the emulsions of the invention the heavier Group VIII metals of Periods 5 and 6. This allows a light, common metal to be employed for grain doping that is an ideal choice from an ecological compatibility viewpoint.

DESCRIPTION OF PREFERRED EMBODIMENTS

Figure 1:
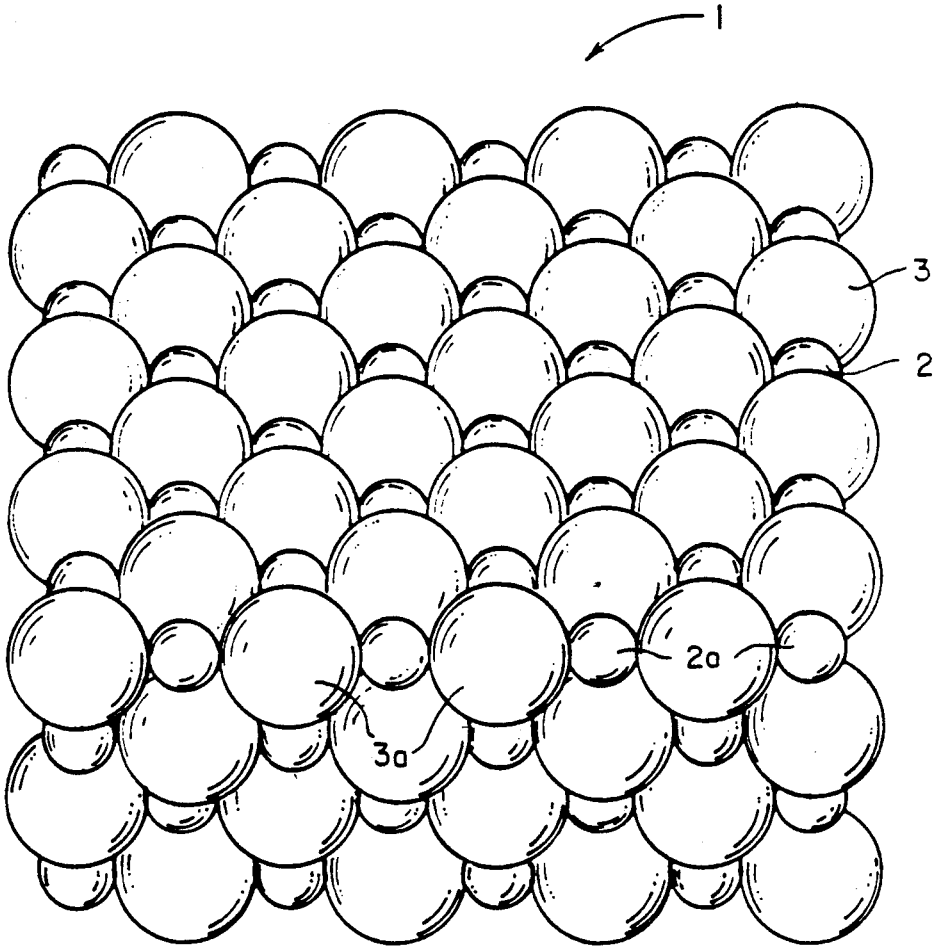
FIG. 1 is a schematic view of a silver bromide crystal structure with the upper layer of ions lying along a {100} crystallographic plane.

The present invention is directed to spectrally sensitized silver bromide and bromoiodide emulsions, collectively referred to as silver brom(oiod)ide emulsions, which exhibit reduced dye desensitization. Such emulsions contain octahedral grains—that is, grains having more than half of their total surface area accounted for by {111} crystal faces.

The grains contain bromide as the halide ion optionally in combination with iodide up to its solubility limit in silver bromide—that is, up to about 40 mole percent, based on total silver. Typically iodide is present in silver bromoiodide grains in concentrations ranging from 0.1 to 20 mole percent, most commonly from about 1 to 10 mole percent.

It has been discovered that dye desensitization attributable to the dye or dyes used to impart spectral sensitivity, typically one or more polymethine dyes, can be optimally reduced when the grains of the emulsion are formed in the presence of a hexacoordination complex of iron having three or more cyanide ligands so that the iron and cyanide ligands are incorporated in a buried shell within the grains.

The buried shell is located on a previously precipitated core grain portion having a diameter equal to at least half of the overall grain diameter and beneath a surface shell surrounding said buried shell having a thickness in the range of from 20 to 350 Å. By burying the iron and cyanide ligands at a shallow depth they are able to influence optimally the interaction of the spectral sensitizing dye with the grain surface. From data presented in the examples below it has been determined that placement of the iron and cyanide ligands in the buried shell location produces better results than incorporating the hexacoordination complex in the core portion of the grains, as results from introducing the coordination complex at or near the beginning of grain precipitation, or placing the coordination complex at or near the surface of the grains, as results from introducing the dopants at or after the end of grain precipitation.

It is generally preferred that the buried shell containing the dopants be located on a core grain portion having at diameter of least half the overall grain diameter. Generally it is preferred that the grain core portion have a diameter at least 70 percent of the overall grain diameter. The larger the mean grain diameter of the emulsion the greater the proportion of the overall grain diameters that can be accounted for by grain core portion while position the buried shell at its desired depth below the grain surface. Locating the hexacoordination complex centrally in the grain maximizes the spacing of the coordination complex from the grain surface and diminishes the ability of the coordination complex to offset dye desensitization.

The buried shell is in all instances separated from the grain surface by a surface shell. The thickness of the surface shell has been found to control optimum performance. Using a surface shell thickness in the range of from 20 to 350 Å—that is burying the dopant containing shell to a depth of 20 to 350 Å—the emulsion exhibits a speed that is twice that realized in the absence of the iron and cyanide ligands. The speed increase can be increased to 2.5 times and higher by locating the buried shell at a depth in the range of from 25 to 100 Å.

It is believed that the coordination complex at its buried shell location is acting as shallow electron trap that is contributing to latent image formation. The invention and its advantages, however, are based on demonstrated performance rather than any particular theory of operation.

The hexacoordinated complexes containing iron and cyanide ligands can be represented by the following formula:

$$[Fe(CN)_{6-y}L_y]^n \quad (I)$$

where

L is a bridging ligand, y is the integer zero, 1, 2 or 3, and n is −3 or −4.

Marchetti et al U.S. Pat. No. 4,937,180, cited above, demonstrated that transition metal complexes with cyanide ligands are incorporated intact in a silver halide face centered cubic crystal lattice structure, and further investigations of complexes satisfying formula (I) have confirmed this determination. The entire hexacoordinated cyanide ligand iron complex is incorporated intact in the grains being formed. To understand how this can be possible, it is helpful to first review the structure of silver halide grains. Unlike silver iodide, which commonly forms only $\beta$ and $\gamma$ phases and is rarely used in photography, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of atoms shown counting from the bottom of FIG. 1 lie in a {100} crystallographic plane which perpendicularly intersects the {100} crystallographic plane occupied by the upper layer of ions. The row containing silver ions 2*a* and bromide ions 3*a* lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The manner in which a hexacoordinated transition metal complex can be incorporated in the grain structure can be roughly appreciated by considering the characteristics of a single silver ion and six adjacent halide ions (hereinafter collectively referred to as the seven vacancy ions) that must be omitted from the crystal structure to accommodate spatially the hexacoordinated iron complex. The seven vacancy ions exhibit a net charge of −5. This suggests that anionic iron complexes should be more readily incorporated in the crystal structure than neutral or cationic transition metal complexes. This also suggests that the capability of a hexacoordinated iron complex to trap either photogenerated holes or electrons may be determined to a significant degree by whether the complex introduced has a net charge more or less negative than the seven vacancy ions it displaces. This is an important departure from the common view that transition metals are incorporated into silver halide grains as bare ions or atoms and that their hole or electron trapping capability is entirely a function of their oxidation state.

Referring to FIG. 1, it should be further noted that the silver ions are much smaller than the bromide ions, though silver lies in the 5th period while bromine lies in the 4th period. Further, the lattice is known to accommodate iodide ions (in concentrations of up to 40 mole percent, noted above) which are still larger than bromide ions. Thus, the ions of iron, which is 4th period metal, are small enough to enter the lattice structure with ease. A final observation that can be drawn from the seven vacancy ions is that the six halide ions exhibit an ionic attraction not only to the single silver ion that forms the center of the vacancy ion group, but are also attracted to other adjacent silver ions.

Hexacoordinated complexes exhibit a spatial configuration that is compatible with the face centered cubic crystal structure of photographically useful silver halides. The six ligands are spatially comparable to the six halide ions next adjacent to a silver ion in the crystal structure. To appreciate that a hexacoordinated iron complex having ligands other than halide ligands can be accommodated into silver halide cubic crystal lattice structure it is necessary to consider that the attraction between the transition metal and its ligands is not ionic, but the result of covalent bonding, the latter being much stronger than the former. Since the size of a hexacoordinated complex is determined not only by the size of the atoms forming the complex, but also by the strength of the bonds between the atoms, a hexacoordinated complex can be spatially accommodated into a silver halide crystal structure in the space that would otherwise be occupied by the seven vacancy ions, even though the number and/or diameters of the individual atoms forming the complex exceeds that of the vacancy ions. This is because the covalent bond strength can significantly reduce the bond distances and therefore the size of the entire complex. Thus, the multielement ligands of hexacoordinated iron complexes can be spatially accommodated to single halide ion vacancies within the crystal structure.

Hexacoordination complexes satisfying the requirements of this invention are those which contain iron and 3, 4, 5 or 6 cyanide ligands. When less than 6 cyanide ligands are employed, the remaining ligands or ligand can be any convenient conventional bridging ligand. The latter when incorporated in the silver halide crystal structure are capable of serving as bridging groups between two or more metal centers. These bridging ligands can be either monodentate or ambidentate. A monodentate bridging ligand has only one ligand atom that forms two (or more) bonds to two (or more) different metal atoms. For monoatomic ligands and for those containing only one donor atom, only the monodentate form of bridging is possible. Multielement ligands with more than one donor atom can also function in a bridging capacity and are referred to as ambidentate ligands. Preferred bridging ligands are monoatomic monodentate ligands, such as halides. Fluoride, chloride, bromide and iodide ligands are all specifically contemplated. Multielement ligands, such as azide and thiocyanate ligands, are also specifically contemplated. Bridging ligands can be selected from among those disclosed for the transition metals disclosed by Janusonis et al U.S. Pat. No. 4,835,093, McDugle et al U.S. Pat. No. 4,933,272, Marchetti et al U.S. Pat. No. 4,937,180 and Keevert et al U.S. Pat. No. 4,945,035, the disclosures of which are here incorporated by reference. Bridging ligands which are desensitizers should, of course, be avoided.

Any net ionic charge exhibited by the hexacoordinated iron complexes contemplated for grain incorporation is compensated by a counter ion to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

The hexacoordination iron complexes can be incorporated in the emulsions in any concentration effective to reduce dye desensitization. Adjustments of concentrations for optimum response for a specific application are a routine undertaking in preparing photographic emulsions. It is generally preferred to form the grains in the presence of from $10^{-4}$ to 0.1 mole percent (preferably $5\times10^{-4}$ to $10^{-2}$ mole percent or, more specifically, $10^{-3}$ to $10^{-2}$ mole percent) of the hexacoordination iron complex, based on final silver—that is, the based on the amount of silver in the grains as fully formed.

Incorporation of the coordination complexes in the grains of the emulsion is achieved by introducing the coordination complex into the reaction vessel during grain precipitation. The rate of incorporation of the coordination complex is roughly equal to the rate of silver and bromide ion precipitation. Thus, by introducing the coordination complex in the desired concentration during precipitation of the buried shell portion of the grain, the coordination complex is incorporated in the grain crystal structure at this location. Portion of the grain structure that has precipitated before the coordination complex is introduced forms the core portion of the grains while the portion of the grain structure that is precipitated after introduced coordination complex has been precipitated forms the surface shell portion of the grain structure. The dopant introduction techniques disclosed by Marchetti et al U.S. Pat. No. 4,937,180, including the teachings referenced therein, can be readily managed to achieve the coordination complex doping profile contemplated by the invention.

Apart from the features specifically described above, the grains and their formation can take any convenient conventional form, as illustrated by *Research Disclosure*, Vol. 308, December 1989, Item 308119, Section I. *Research Disclosure* is published by Kenneth Mason Publications, Ltd., Dudley Annex, 21*a* North Street, Emsworth, Hampshire P010 7DQ, England. The emulsions once formed can be washed and chemically sensitized as illustrated by Sections II and III of *Research Disclosure* Item 308119.

Spectral sensitization of the iron cyanide ligand coordination complex doped grains can be undertaken by any convenient conventional procedure. Generally the buried shell grain structure contemplated is effective to offset dye desensitization attributable to all classes of dyes known to be spectral sensitizers, including the polymethine dye class, which includes the cyanines, merocyanines, complex cyanines and merocyanines (i.e., tri-, tetra- and polynuclear cyanines and merocyanines), oxonols, hemioxonols, styryls, merostyryls and streptocyanines.

The most widely employed spectral sensitizing dyes are the cyanine class of dyes. Cyanine spectral sensitizing dyes include, joined by a methine linkage, two basic heterocyclic nuclei, such as those derived from quinolinium, pyridinium, isoquinolinium, 3H indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium, dihydronaphthothiazolium, pyrylium and imidazopyrazinium quaternary salts. The basic heterocyclic nuclei can also include tellurazoles or oxatellurazoles as described by Gunther et al U.S. Pat. Nos. 4,575,483, 4,576,905 and 4,599,410. The methine linkage of cyanine dyes contain a single methine group in simple cyanine dyes, three methine groups in carbocyanine dyes and five, seven, nine, etc. methine groups in higher homologues. A portion of the methine linking unit of the dyes can be cyclized, particularly in the more extended methine linking units. It is also well recognized that one or more of methine groups can be replaced by an aza (—N=) linking group.

The merocyanine spectral sensitizing dyes include, Joined by a methine linkage, a basic heterocyclic nucleus of the cyanine-dye type and an acidic nucleus such as can be derived from barbituric acid, 2 thiobarbituric acid. rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, malononitrile, isoquinolin-4-one, and chroman-2,4-dione. The merocyanine dyes may include telluracyclo-hexanedione as acidic nucleus as described in Japanese Patent Application JA 51/136,420. Simple merocyanines contain a double bond linkage of their nuclei, dimethine merocyanines have two methine groups linking their nuclei. Tetramethine merocyanines and higher homologues are known.

One or more spectral sensitizing dyes may be used. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

The chemistry of cyanine and related dyes is illustrated by Weissberger and Taylor, *Special Topics of Heterocyclic Chemistry*, John Wiley and Sons, New York, 1977, Chapter VIII; Venkataraman, *The Chemistry of Synthetic Dyes*, Academic Press, New York, 1971, Chapter V; James, *The Theory of the Photographic Process*, 4th Ed., Macmillan, 1977, Chapter 8, and F. M. Hamer, *Cyanine Dyes and Related Compounds*, John Wiley and Sons, 1964.

Among useful spectral sensitizing dyes for sensitizing the emulsions of this invention are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747 '748, 2,526,632, 2,739,964 U.S. Pat. No. (Re. 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898.

It is contemplated to add the spectral sensitizing dyes to the emulsions at any convenient stage following precipitation of the surface shell portion of the grains. Spectral sensitizing dyes and their addition are described in *Research Disclosure* Item 308119, cited above, Section IV.

Apart from the emulsion features described above, the emulsions and photographic elements for their use can take any of a wide variety of conventional forms. These features are surveyed in *Research Disclosure*, Item 308119, cited above and here incorporated by reference.

In the foregoing description the various "diameters" referred to in describing the grains are effective circular diameters—that is the diameter of a circle having an area equalling the projected area of the grain.

EXAMPLES

The invention can be better appreciated by reference to the following specific examples. The abbreviation "D.W." is used to indicate distilled water.

EXAMPLE 1

This example illustrates the application of the invention to silver bromide emulsions.

Six solutions were prepared as follows:

| | |
|---|---|
| Solution 1 (1) | |
| Gelatin (bone) | 50 gm |
| D. W. to total volume | 2000 mL |
| Solution 2 (1) | |
| Sodium bromide | 10 gm |
| D. W. to total volume | 100 mL |
| Solution 3 (1) | |
| Sodium bromide | 412 gm |
| D. W. to total volume | 1600 mL |
| Solution 4 (1) | |
| Silver nitrate (5 Molar) | 800 mL |
| D. W. to total volume | 1600 mL |
| Solution 5 (1) | |
| Gelatin (phthalated) | 50 gm |
| D. W. to total volume | 300 mL |
| Solution 6 (1) | |
| Gelatin (bone) | 130 mL |
| D. W. to total volume | 400 mL |

Solution 1(1) was adjusted to a pH of 3.0 with nitric acid at 40° C. The temperature of solution 1(1) was adjusted to a 70° C. Solution 1(1) was then adjusted to a pAg of 8.2 with solution 2(1). Solutions 3(1) and 4(1) were simultaneously run into the adjusted solution 1(1) at a constant rate for the first 4 minutes with introduction being accelerated for the next 40 minutes. The addition rate was held constant over a final 2-minute period for a total addition time of 46 minutes. The pAg was maintained at 8.2 over the entire run. After the addition of solutions 3(1) and 4(1), the temperature was adjusted to 40° C., the pH was adjusted to 4.5, and solution 5(1) was added. The mixture was then held for 5 minutes, after which the pH was adjusted to 3.0 and the gel allowed to settle. At the same time the temperature was dropped to 15° C. before decanting the liquid layer. The depleted volume was restored with distilled water. The pH was readjusted at 4.5, and the mixture held at 40° C. for ½ hour before the pH was adjusted to 3.0 and the settling and decanting steps were repeated. Solution 6(1) was added, and the pH and pAg were adjusted to 5.6 and 8.2, respectively. This emulsion (1A) was digested with 3 mg per Ag mole of $Na_2S_2O_3 \cdot 5H_2O$ and 2 mg per Ag mole $KAuCl_4$ for 30 minutes at 70° C.

Coatings were made at 27 mg Ag/dm$^2$ and 86 mg gelatin/dm$^2$. The coatings were exposed in the dye absorption region with a standard sensitometer at 1/10 sec with a wratten 9 filter and a 5500K source. Some coatings were also exposed at $10^{-4}$ sec. to determine reciprocity behavior. Exposed coatings were developed for 6 min. in a standard developer containing Elon TM (N-methyl-p-aminophenol hemisulfate), hydroquinone, $Na_2SO_3$, KBr and buffered to a pH of 10.5.

A second emulsion (1B) was prepared like 1A with $K_4Fe(CN)_6$ at a formal concentration of 12.5 molar parts per million added in the salts after ¾ of the reagents had been added. The dopant incorporation was analyzed by inductively coupled plasma atomic emission. This emulsion was digested and prepared as emulsion 1A.

A third emulsion (1C) was prepared like 1A with $K_4Fe(CN)_6$ at a formal concentration of 12.5 molar parts per million added in the salts after about ¾ of the reagents had been added but with enough undoped reagents held back so as to create a 25 Å shell. This emulsion was digested and prepared as emulsion 1A.

A fourth emulsion (1D) was prepared like 1A with $K_4Fe(CN)_6$ at a formal concentration of 12.5 molar parts per million added in the salts after about ¾ of the reagents had been added but with enough undoped reagents held back so as to create a 50 Å shell. This emulsion was digested and prepared as emulsion 1A.

A fifth emulsion (1E) was prepared like 1A with $K_4Fe(CN)_6$ at a formal concentration of 12.5 molar parts per million added in the salts after about ¾ of the reagents had been added but with enough undoped reagents held back so as to create a 100 Å shell. This emulsion was digested and prepared as emulsion 1A.

A sixth emulsion (1F) was prepared like 1A with $K_4Fe(CN)_6$ at a formal concentration of 12.5 molar parts per million added in the salts after about ¾ of the reagents had been added but with enough undoped reagents held back so as to create a 400 Å shell. This emulsion was digested and prepared as emulsion 1A.

EXAMPLE 1A

The six emulsions 1A to 1F were coated with a green absorbing cyanine dye, 3,3'-diethyl-9-methyl-thiacarbocyanine chloride at 0.5 monolayer coverage as shown in Table 1(A). The improvement in dye speed for equivalent exposure and processing are shown as a relative speed increase. The optimum depth is established to be greater than 25 but less than 100 Å. Identical results, as far as the optimum depth, were also obtained with this dye at 0.3 and 0.8 monolayer coverage. The changes in reciprocity for exposures at 1/10 sec. and $10^{-4}$ sec. are shown as a change in the relative speed (speed at 1/10 sec.—speed at $10^{-4}$ sec.).

TABLE 1A

| Emulsion | Incorporation | Depth (A) | Speed | Reciprocity |
|---|---|---|---|---|
| 1A (check) | no dopant | — | 100 | 45 |
| 1B | 68 ± 20% | 0 | 135 | 23 |
| 1C | 54% | 25 | 245 | 10 |
| 1D | 68% | 50 | 339 | 12 |
| 1E | ≈100% | 100 | 245 | 15 |
| 1F | 76% | 400 | 195 | 32 |

A seventh emulsion (1G) was prepared like 1A with $K_4Fe(CN)_6$ at a formal concentration of 12.5 molar parts per million added in the salts after about ½ of the reagents had been added but with enough undoped reagents held back so as to create a 150 Å shell. This emulsion was digested and prepared as emulsion 1A.

An eighth emulsion (1H) was prepared like 1A with $K_4Fe(CN)_6$ at a formal concentration of 113 molar parts per million added in the salts after about ½ of the reagents had been added but with enough undoped reagents held back so as to create a 150 Å shell. This emulsion was digested and prepared as emulsion 1A.

An ninth emulsion (1I) was prepared like 1A with $FeCl_3$ at a formal concentration of 50 molar parts per million added in the salts after about ½ of the reagents had been added but with enough undoped reagents held back so as to create a 100 Å shell. This emulsion was digested and prepared as emulsion 1A.

EXAMPLE 1B

Emulsion 1A and emulsions 1G to 1I were coated with a green absorbing cyanine dye, 3,3'-diethyl-9-methylthiacarbocyanine at 0.55 monolayer coverage as shown in Table 1B. The changes in dye speed for equivalent exposure and processing are shown as a relative speed in Table 1B. The speed improvement at a shell thickness of 150 Å for $K_4Fe(CN)_6$ doping is somewhat dependent on concentration with better speed found at the higher concentration. The emulsion doped with $FeCl_3$ showed no speed difference from the check emulsion.

TABLE 1B

| Emulsion | Amount | Speed |
|---|---|---|
| 1A | 0.0 | 100 |
| 1G | 12.5 | 200 |
| 1H | 113 | 224 |
| 1I ($FeCl_3$) | 50 | 102 |

A tenth emulsion (1J) was prepared like 1A with $K_4Fe(CN)_6$ at a formal concentration of 12.5 molar parts per million added in the salts after about ½ of the reagents had been added but with enough undoped reagents held back so as to create a 50 Å shell. This emulsion was digested and prepared as emulsion 1A.

EXAMPLE 1C

Emulsion 1A and emulsion 1J were coated with a green absorbing cyanine dye, 3,3'-diethyl-9-methylthiacarbocyanine chloride at 0.8 monolayer coverage and with a merocyanine dye, N-methyl-2-thiazoline, N-carboxymethylrhodanine-2-methylmero-cyanine at 0.8 monolayer coverage as shown in Table 1C. The changes in dye speed for equivalent exposure and processing are shown as a relative speed in Table 1C. The speed and gamma improvement are found for $K_4Fe(CN)_6$ doping with both dyes.

TABLE 1C

| Emulsion | Dye | Speed | Gamma |
|---|---|---|---|
| 1A | Cyanine | 100 | 1.4 |
| 1J | Cyanine | 309 | 1.7 |
| 1A | Merocyanine | 100 | 3.9 |
| 1J | Merocyanine | 126 | 4.1 |

An eleventh emulsion (1K) was prepared like 1A with $K_4Fe(CN)_6$ at a formal concentration of 12.5 molar parts per million added in the salts after about ¾ of the reagents had been added but with enough undoped reagents held back so as to create a 60 Å shell. This emulsion was digested and prepared as emulsion 1A.

EXAMPLE 1D

Emulsions 1A, 1B and emulsion 1K were coated with a green absorbing cyanine dye, 1,3,1',3'-tetra-ethyl-5,6,5',6'-tetrachlorobenzimidazolocarbocyanine chloride at 0.5 monolayer coverage as shown in Table 1D. The changes in dye speed for equivalent exposure and processing are shown as a relative speed in Table 1D. The speed and gamma improvement are found for $K_4Fe(CN)_6$ doping.

TABLE 1D

| Emulsion | Incorporation | Speed | Gamma |
|---|---|---|---|
| 1A | no dopant | 100 | 1.3 |
| 1B | 68 ± 20% | 257 | 1.7 |
| 1K | 75% | 525 | 1.5 |

EXAMPLE 1E

Emulsions 1A, 1B and emulsion 1K were coated with a green absorbing cyanine dye, 3-(3-sulfo-propyl), 3'-(3-sulfobutyl)-5-chloro-5'-phenyl-9-ethyl-oxacarbocyanine, sodium salt at 0.5 and 0.8 monolayer coverage as shown in Table 1E. The changes in dye speed for equivalent exposure and processing are shown as a relative speed in Table 1E. Speed improvement is found for $K_4Fe(CN)_6$ doping.

TABLE 1E

| Emulsion | Dye level | Speed |
|---|---|---|
| 1A | 0.5 | 100 |
| 1B | 0.5 | 62 |
| 1K | 0.5 | 145 |
| 1A | 0.8 | 100 |
| 1B | 0.8 | 93 |
| 1K | 0.8 | 204 |

EXAMPLE 1F

Emulsion 1A and emulsions 1G to 1I were coated with a green absorbing cyanine dye, 3-(3-sulfopropyl), 3'-(3-sulfobutyl)-5-chloro-5'-phenyl-9-ethyloxacarbocyanine, sodium salt at 0.89 monolayer coverage as shown in Table 1F. The changes in reciprocity for exposures at 1 sec. and $10^{-4}$ sec. are shown as a change in the relative speed (speed at 1 sec. speed at $10^{-4}$ sec.) in Table 1F. The reciprocity improvement at a shell thickness of 150 Å for $K_4Fe(CN)_6$ doping is only found at the higher concentration. The emulsion doped with $FeCl_3$ shows no reciprocity improvement.

TABLE 1F

| Emulsion | Reciprocity |
|---|---|
| 1A | 51 |
| 1G | 51 |
| 1H | 17 |
| 1I | 74 |

Emulsions 1A, 1G, 1H and 1I were examined spectrophotometrically before digestion. These emulsions were cooled to 6° K in a standard metal dewar and excited with 365 nm light. The undoped emulsion, 1A, exhibited emission bands at 495 and 580 nm. These bands have been previously observed in AgBr [A. P. Marchetti, *J. Phys. C: Solid State Phys.*, 14 961 (1981) and references cited therein.] The low concentration $K_4Fe(CN)_6$ doped emulsion exhibited intense new bands at 630 and 750 nm while in the emulsion with a higher concentration, these bands appear to coalesce into a single intense band at 660 nm. The $FeCl_3$ doped emulsion shows no new emission bands This data is shown in Table 1G.

TABLE 1G

| Emulsion | Emission Band Maxima (nm) |
|---|---|
| 1A | 495, 580 |
| 1G | 495, 580(sh), 630, 750 |
| 1H | 495, 580(sh), 660 |
| 1I | 495, 580 |

EXAMPLE 2

This example illustrates the application of this invention to silver bromoiodide emulsions.

Seven solutions were prepared as follows:

| | |
|---|---|
| Solution 1 (2) | |
| Gelatin (bone) | 50 gm |
| D. W. to total volume | 2000 mL |
| Solution 2 (2) | |
| Sodium bromide | 10 gm |
| D. W. to total Volume | 100 mL |
| Solution 3 (2a) | |
| Sodium bromide | 206 gm |
| D. W. to total volume | 800 mL |
| Solution 3 (2b) | |
| Sodium bromide | 198 gm |
| Potassium iodide | 13.2 gm |
| D. W. to total volume | 800 mL |
| Solution 4 (2) | |
| Silver nitrate (5 Molar) | 800 mL |
| D. W. to total volume | 1600 mL |
| Soluton 5 (2) | |
| Gelatin (phthalated) | 50 gm |
| D. W. t total volume | 300 mL |
| Solution 6 (2) | |
| Gelatin (bone) | 130 mL |
| D. W. to total volume | 400 mL |

Solution 1(2) was adjusted to a pH of 3.0 with nitric acid at 40° C. The temperature of solution 1(2) was adjusted to a 70° C. Solution 1(2) was then adjusted to a pAg of 8.2 with solution 2(2). Solutions 3(2a) and 4(2) were simultaneously run into the adjusted solution 1(2) at a constant rate for the first 4 minutes. Solution 3(2b) was then substituted for solution 3(2a) with introduction being accelerated for the next 40 minutes. When solution (2b) was exhausted, it was replaced by solution (2a). The addition rate was held constant over a final 2-minute period for a total addition time of 46 minutes. The pAg was maintained at 8.2 over the entire run. After the addition of solutions 3(1) and 4(1), the temperature was adjusted to 40° C., the pH was adjusted to 4.5, and solution 5(1) was added. The mixture was then held for 5 minutes, after which the pH was adjusted to 3.0 and the gel allowed to settle. At the same time the temperature was dropped to 15° C. before decanting the liquid layer. The depleted volume was restored with distilled water. The pH was readjusted at 4.5, and the mixture held at 40° C. for ½ hour before the pH was adjusted to 3.0 and the settling and decanting steps were repeated. Solution 6(1) was added, and the pH and pAg were adjusted to 5.6 and 8.2, respectively. This emulsion (2A) was digested with 3 mg per Ag mole of $Na_2S_2O_3.5H_2O$ and 2 mg per Ag mole $KAuCl_4$ for 30 minutes at 70° C. Coatings were made at 27 mg Ag/dm$^2$ and 86 mg gelatin/dm$^2$. The coatings were exposed in the dye absorption region with a standard sensitometer at 1/10 sec. with a wratten 9 filter and a 5500° K source. Exposed coatings were developed for 6 min. in a standard developer containing Elon TM, hydroquinone, $Na_2SO_3$, KBr and buffered to a pH of 10.5.

A second emulsion (2B) was prepared like 2A with $K_4Fe(CN)_6$ at a formal concentration of 12.5 molar parts per million added in the salts after about ¾ of the reagent had been added, but with enough undoped reagent held back to form a 50 Å shell. This emulsion was digested and prepared as emulsion 1A.

EXAMPLE 2A

Emulsions 2A and 2B were coated with a green absorbing cyanine dye, 3-(3-sulfopropyl), 3'(3'-sulfobutyl)-5-chloro-5'-phenyl-9-ethyloxacarbocyanine, sodium salt at 0.5 monolayer coverage as shown in Table 2A. The changes in dye speed for equivalent exposure and processing are shown as a relative speed in Table 2A. Speed improvements are found for $K_4Fe(CN)_6$ doping.

TABLE 2A

| Emulsion | Incorporation | Speed |
|---|---|---|
| 2A | no dopant | 100 |
| 2B | approx. 100% | 141 |

EXAMPLE 2B

Emulsions 2A and 2B were coated with a green absorbing cyanine dye 1,3,1',3'-tetraethyl-5,6,5', 6'-tetrachlorobenzimidazolocarbocyanine chloride at 0.3 and 0.5 monolayer coverage as shown in Table 2B. The changes in dye speed for equivalent exposure and processing are shown as a relative speed in Table 2B. The speed and gamma improvements are found for $K_4Fe(CN)_6$ doping.

TABLE 2B

| Emulsion | Dye Level | Speed | Gamma |
|---|---|---|---|
| 2A | 0.3 | 100 | 2.17 |
| 2B | 0.3 | 148 | 2.31 |
| 2A | 0.5 | 100 | 1.77 |
| 2B | 0.5 | 182 | 1.89 |

The invention has been described in detail with particular reference to preferred embodiments thereof, but it will be understood that variations and modifications can be effected within the spirit and scope of the invention.

What is claimed is:

1. A photographic emulsion comprised of radiation-sensitive silver bromide grains optionally containing iodide exhibiting a face centered crystal structure and having {111} crystal faces and a spectral sensitizing dye adsorbed to the surface of the grains, characterized in that said grains each contain a buried shell formed in the presence of a hexacoordination complex of iron and at least three cyanide ligands, said buried shell being located on a core grain portion having a diameter equal to at least half of the grain diameter and beneath a surface shell surrounding said buried shell, said surface shell having a thickness in the range of from 20 to 350 Å.

2. A photographic emulsion according to claim 1 further characterized in that said grains contain from about 0.1 to 20 mole percent iodide, based on total silver.

3. A photographic emulsion according to claim 2 further characterized in that said grains contain from about 1 to 10 mole percent iodide, based on total silver.

4. A photographic emulsion according to claim 1 further characterized in that silver halide forming said grains consists essentially of silver bromide.

5. A photographic emulsion according to claim 1 further characterized in that said silver halide grains exhibit at least one of sulfur and gold surface sensitization.

6. A photographic emulsion according to claim 1 further characterized in that said hexacoordination complex satisfies the formula:

$$[Fe(CN)_{6-y}L_y]^n$$

where

L is a bridging ligand, y is the integer zero, 1, 2 or 3 and n is −3, or −4.

7. A photographic emulsion according to claim 6 further characterized in that L is a halide ligand.

8. A photographic emulsion according to claim 6 further characterized in that said hexacoordination complex satisfies the formula $$[Fe(CN)_6]^{-4}.$$

9. A photographic emulsion according to claim 6 further characterized in that said emulsion contains from $10^{-4}$ to 0.1 mole percent of the hexacoordination complex, based on silver.

10. A photographic emulsion according to claim 9 further characterized in that said emulsion contains from $5\times10^{-4}$ to $10^{-2}$ mole percent of the hexacoordination complex, based on silver.

11. A photographic emulsion according to claim 1 further characterized in that said core grain portion has a diameter which is at least 70 percent of the overall grain diameter.

12. A photographic emulsion according to claim 1 further characterized in that said surface shell portion has a thickness in the range of from 25 to 100 Å.

* * * * *